United States Patent [19]

Watanabe et al.

[11] Patent Number: 5,045,358

[45] Date of Patent: Sep. 3, 1991

[54] COATING HEAD ASSEMBLY AND COATING METHOD

[75] Inventors: Keigo Watanabe, Neyagawa; Hiroyuki Naka, Osaka; Takashi Ichiyanagi, Hirakata, all of Japan

[73] Assignee: Matsushita Electric Industrial Co., Ltd., Osaka, Japan

[21] Appl. No.: 428,515

[22] Filed: Oct. 30, 1989

[51] Int. Cl.[5] ..... B05D 3/12; B05D 5/00; B05C 3/15

[52] U.S. Cl. ..... 427/172; 427/286; 118/33; 118/412

[58] Field of Search ..... 427/286, 172, 176; 118/412, 411, 33

[56] References Cited

U.S. PATENT DOCUMENTS

| | | | |
|---|---|---|---|
| 428,188 | 5/1890 | Videto | 118/412 |
| 3,278,960 | 10/1966 | Nardone | 427/286 X |
| 3,511,730 | 5/1970 | Carder | 118/411 X |
| 4,220,114 | 9/1980 | Radowicz | 118/411 |

*Primary Examiner*—Evan Lawrence

*Attorney, Agent, or Firm*—Wenderoth, Lind & Ponack

[57] ABSTRACT

A coating head assembly for applying a coating material to a web, comprises an applicator block; a paint reservoir defined in the applicator block for the storage of the coating material; and a generally elongated nozzle integral with the applicator block and extending in a direction substantially transverse to the direction of transportation of the web. A free edge of the nozzle opposite to the applicator block has a generally curved nozzle face. This nozzle face has a plurality of applicator grooves defined therein in communication with the paint reservoir. During the passage of the web in sliding contact with the nozzle face, the coating material is supplied outwardly from the applicator grooves for the transfer thereof onto the web, resulting in the formation of a striped pattern of the coated layer on the web.

6 Claims, 2 Drawing Sheets

COATING HEAD ASSEMBLY AND COATING METHOD

BACKGROUND OF THE INVENTION

1. Field of the Invention

The present invention generally relates to the art of applying a liquid coating material to a web of film such as, for example, a photographic film or a magnetic recording tape. More specifically, the present invention relates to a coating head assembly for, and a method of, applying a liquid coating material to a web of film to form thin parallel strips of coating material on the film web.

2. Description of the Prior Art

When it comes to the application of a coating material on a web of film such as, for example, a web of photographic film or a web of magnetic recording tape, various method have been well know including, for example, a gravure roll coating technique, a reverse roll coating technique and so on. These methods have their own applications and the selection of one of these methods depends on the purpose for which it is utilized. Of these various method, the reverse roll coating system is employed where parallel strips of coating material extending over the length of the web of film and spaced equally over the width thereof are desired to be formed on the film web. Since the present invention pertains to the formation of the parallel strips of coating material on the film web, the prior art reverse roll coating system will now be discused in detail with particular reference to FIG. 5.

Referring to FIG. 5, the prior art coating machine comprises a rotatably supported back-up roll 72 around which a web 71 of film is turned during its transportation in one direction, a transfer roll 73 juxtaposed with the back-up roll 72 for rotation at a predetermined speed in one direction counter to the direction of rotation of the back-up roll 72 and having a plurality of axially equally spaced annular grooves defined therein in a circumferential direction thereof while leaving a corresponding number of annular lands on the peripheral surface of such transfer roll, and an applicator roll 74 juxtaposed with the transfer roll 73 for rotation in a direction counter to the direction of rotation of the transfer roll 73 and poitioned on one side of the transfer roll 73 remote from the back-up roll 72. The machine shown therein also comprises a paint reservoir 76 in which the applicator roll 74 is partly immersed so that, during the rotation of the applicator roll 74, a coating material within the paint reservoir 76 can be applied onto and transferred by the applicator roll 74 towards the transfer roll 73, a metering roll 75 for metering the coating material being transported by the applicator roll 74 towards the transfer roll 73, and a squeegee blade 77 for removing the coating material sticking on the peripheral surface of the metering roll 75 for the recovery thereof into the paint reservoir 76.

The prior art coating machine of the above described construction operates in the following manner. Assuming that the coating machine is electrically powered with the applicator roll 74 driven at a predetermined peripheral velocity, the applictor roll 74 is successively immersed in the paint reservoir 76 so that the peripheral surface of the applicator roll 74 can be wetted with the coating material within the paint reservoir 76. The coating material transported by the application roll 74 is subsequently metered by the metering roll 74 and is then transferred onto the transfer roll 73, adhering to the annular lands on the peripheral surface of the transfer roll 73 so that portions of the coating material transferred onto the annular lands can subsequently be applied to the film web 71. The application of the coating material from the transfer roll 73 to the film 71 takes place while the film web 71 is continuously transported in the predetermined direction around the back-up roll 72 and, therefore, striped deposits of the coating material can be formed on one surface of the film web 71.

In the prior art reverse roll coating machine of the type referred to above, the maximum coating speed is said to be generally to about 200 m/min, for there may be a possibility that at a higher coating speed the coating material carried by any one of the various rolls may scatter under the influence of a centrifugal force induced by the rotation of the associated roll.

Also, since the coating material, liquid in phase, contacts the ambient air, the coating material if diluted with a solvent prior to the actual application thereof tends to evaporate in contact with ambient air enough to facilitate change in its characteristics with time. Therefore, the deposits of the coating material tend to become susceptible to deterioration. Considering that rationalization of the coating process is required to facilitate a mass-production of coated products, the above described problems are not negligible.

On the other hand, where the coating material diluted with a solvent is employed, the coating material deposited on a film web undergoes a considerable volume shrinkage as the deposited coating material is cured or hardened in a drying process. The magnitude of the volume shrinkage varies with the type of one or both of the coating material and the solvent and will generally amount to about 1/5 to 1/20 relative to the thickness of the coating material as coated on the film web. The shrinkage and the hardening occurring at this time will now be discussed. The coating material on the surface of the film web is held immovable, having satisfied a NO-Slip condition referred to in the field of fluid dynamics, and therefore, no apparent change is observable at the interface between the coating material and the film web while a free fluid above the interface undergoes a motion consequent upon the shrinkage to thereby determine a final pattern or shape of distribution of the coated material. A diagrammatic representation of the coating material in motion above the interface between it and the film web is illustrated in FIG. 6, wherein reference numeral 1 represents a portion of the film web, reference numeral 2 represents an uncured coating material applied to the film web portion 1 and reference numeral 3 represents the coating material having been dried to form a coated layer. As can be understood from FIG. 6, the coated layer 3 has its edges rounded as indicated by circles A.

When it comes to the continuous formation of strips of coated layers spaced an equal distance from each other over the width of the film web, variation of the uniformity in thickness of the coated layers resulting from run or sagging of coating material at edges thereof may pose a critical problem because the neighboring coated layers are spaced a small distance from each other.

SUMMARY OF THE INVENTION

Accordingly, the present invention has been devised with a view to substantially eliminating the above discussed problems and has for its essential object to provide an improved coating device effective to accomplish a high speed coating, to avoid any possible occurrence of run or sagging of coating material, and to avoid any possible occurrence of defective coating during natural drying thereof.

It is a related object of the present invention to provide a method of applying a coating material to a web of film to form a striped pattern of coating layers threreon.

To this end, the present invention features the use of a coating head assembly having a generally elongated nozzles extending in a direction perpendicular to the direction of transport of a web of film. The nozzle has a plurality of grooves of predetermined depth defined therein and spaced an equal distance from each other in a direction lengthwise of the nozzle. In the practice of the present invention, the web of film is transported past the coating nozzle under tension.

According to the present invention, the use of the coating head assembly substantially eliminates any possible scattering of coating material under the influence of a centrifugal force and, also, the natural drying phenomenon of the coating material. In addition, the coating head assembly according to the present invention is effective to apply the coating material to the film web to form a striped pattern of coated layers thereon at a high speed. According to the method herein disclosed, since the film web is held under tension during its passage around the coating nozzle, portions of the film web where the coating material is subsequently applied are allowed to protrude into the respective grooves in the coating nozzle so that any possible subsequent occurrence of run or sagging of the coating material can be advantageously avoided.

BRIEF DESCRIPTION OF THE DRAWINGS

These and other objects and features of the present invention will become clear from the following description taken in conjunction with a preferred embodiment thereof with reference to the accompanying drawings, in which.

DESCRIPTION OF THE PREFERRED EMBODIMENT

As stated above, the present invention is intended to provide a coating device effective to accomplish a high speed coating, to avoid any possible occurrence of run or sagging of coating material, and to avoid any possible occurence of defective coating during natural drying thereof. For this purpose, use is made of a coating head assembly having a generally elongated nozzle extending in a direction perpendicular to the direction of transport of a web of film. The nozzle has a plurality of grooves of predetermined depth defined therein and spaced an equal distance from each other in a direction lengthwise of the nozzle.

Figure 1:
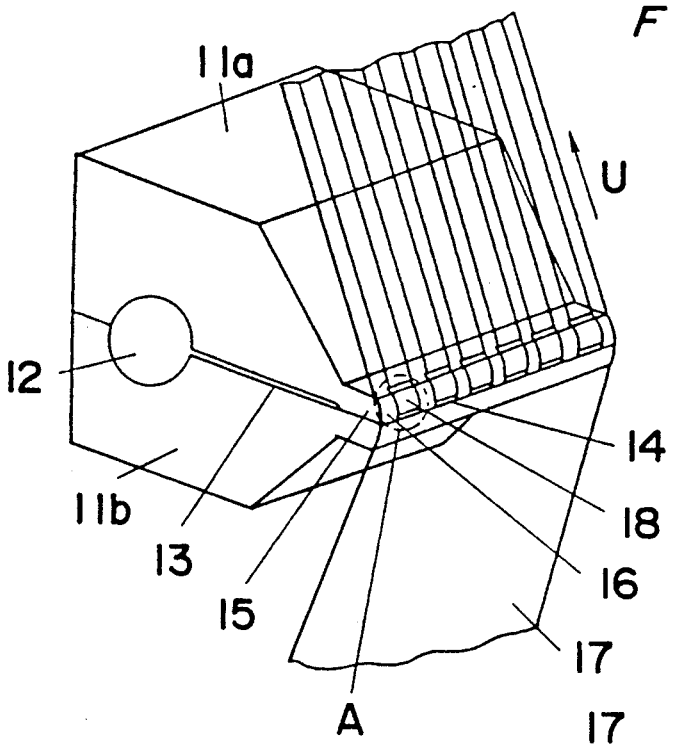
FIG. 1 is a schematic perspective view of a coating head assembly embodying the present invention.

Referring now to FIG. 1, the coating head assembly comprises an applicator block of two-piece construction including first and second dies 11*a* and 11*b* assembled together so that a paint reservoir 12 and a plurality of parallel paint supply passages 13 communicated with the paint reservoir 12 can be defined in the resultant applicator block. The applicator block comprising the dies 11*a* and 11*b* is of a shape having a generally elongated nozzle 15 generally tapered outwardly from the body of the applicator block so as to terminate with a rounded nozzle face 16. The nozzle 15 extends in a direction transverse to the direction of travel of a web of film 17 and also to the direction in which the paint supply passes 13 extend from the paint reservoir 12. The length of the nozzle 15 is chosen to correspond to the width of the film web 17.

The film web 17 is adapted to be transported at a predetermined speed U relative to the nozzle face 16 and is, during its transportation, held in sliding contact with the nozzle face 16 while turned a predetermined angle therearound. The paint reservoir 12 defined in the applicator block is in turn fluid-connected with a source (not shown) of coating material 14 in any suitable manner.

Figure 2:
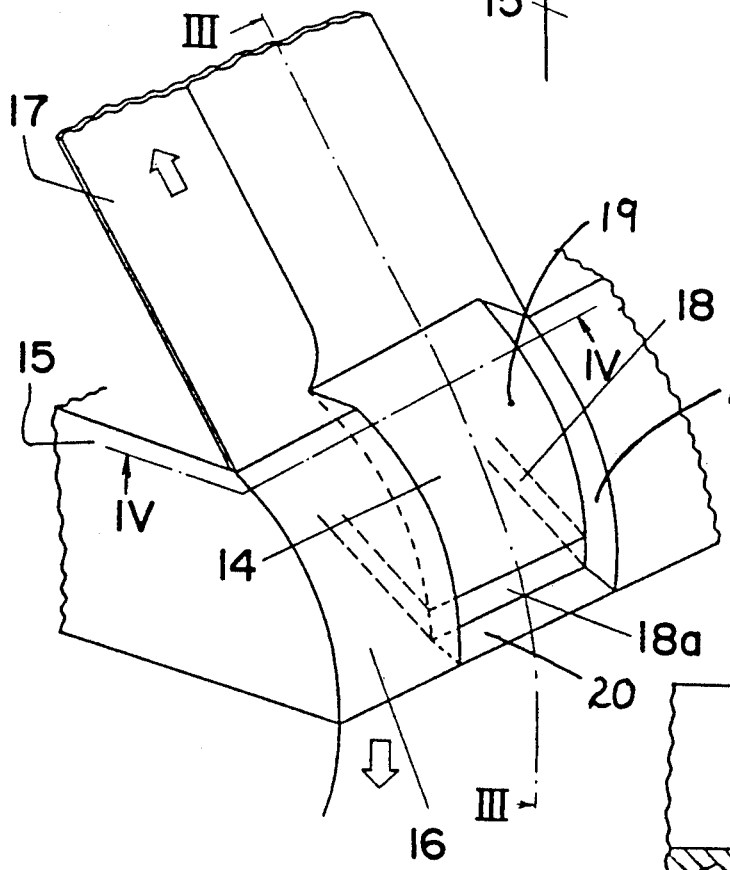
FIG. 2 is a fragmentary perspective view, on an enlarged scale, of that portion of the coating head assembly which is enclosed in a circle A in FIG. 1.

As best shown in FIGS. 1 and 2, the nozzle face 16 is formed with a plurality of applicator grooves 18 defined therein so as to extend inwardly of the applicator nozzle 15 and spaced an equal distance from each other over the length of the applicator nozzle 15. Each of the applicator grooves 18 has a predetermined depth as measured in a direction inwardly of the nozzle 15 and a predetermined width as measured in a direction lengthwise of the nozzle 15 and is defined by a base surface 19, a bottom wall 20, and a pair of sidewalls 21 extending perpendicularly from the bottom wall 20. Each of the applicator grooves 18 is communicated with a respective supply passage 13 through a generally rectangular slit-shaped opening 18*a* defined at a bottom portion of the applicator groove 18.

Figure 3:
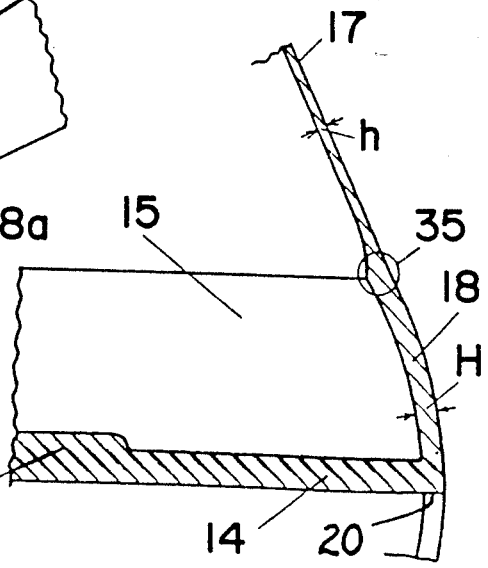

A cross-sectional representation of the nozzle 15 taken along the line III—III in FIG. 2 is shown in FIG. 3. In FIG. 3, reference numeral 35 represents a free surface area at which a coating material applied to the film web 17 contacts the atmosphere.

The coating machine utilizing the coating head assembly of the above described construction operates in the following manner. The liquid coating material 14 supplied from the source thereof is temporarily stored in the reservoir 12. The continued supply of the coating material from the source thereof into the reservoir 12 causes an internal pressure inside the reservoir 12 to increase so that the coating material within the reservoir 12 can be subsequently supplied under pressure towards the openings 18*a* in the respective applicator grooves 18 through the supply passages 13, having overcome a flow resistance imparted by the passages 13 and the openings 18*a*. The coating material so supplied emerges outwardly from the openings 18*a* in the respective applicator grooves 18 and is then applied to the film web 17 as the latter is passed around and in sliding contact with the nozzle face 16 in the predetermined direction at the predetermined speed. During the passage of the film web 17 around and past the nozzle face 16, the film web 17 is held under tension. Partly because the free edge of the nozzle 15 is curved or substantially rounded at a predetermined radius of curvature to define the nozzle face 16 and partly because the film web 17 being moved is held under tension, the sliding contact of the film web 17 with the nozzle face 16 results in the film web 17 being held in tight contact with nozzle face 16.

Therefore, the resultant paint layers coted on the film web in a striped pattern are confined within the respective applicator grooves 18 other than respective portions thereof confronting the free surface areas 35. In this manner, change with time of the coated paint layers which would occur as a result of a natural evaporation of the solvent used can be advantageously minimized. Also, the coated paint confined within the respective applicator grooves 18 will not scatter under the influence of a centrifugal force. Therefore, the coating at a speed higher than about 200m/min is possible with the coting head assembly of the present invention.

As hereinabove described, the present invention is effective to provide the coated layers free from any defect which would otherwise result from the natural drying of the coating material, which coated layers can be continuously formed at about 200m/min.

Figure 5:
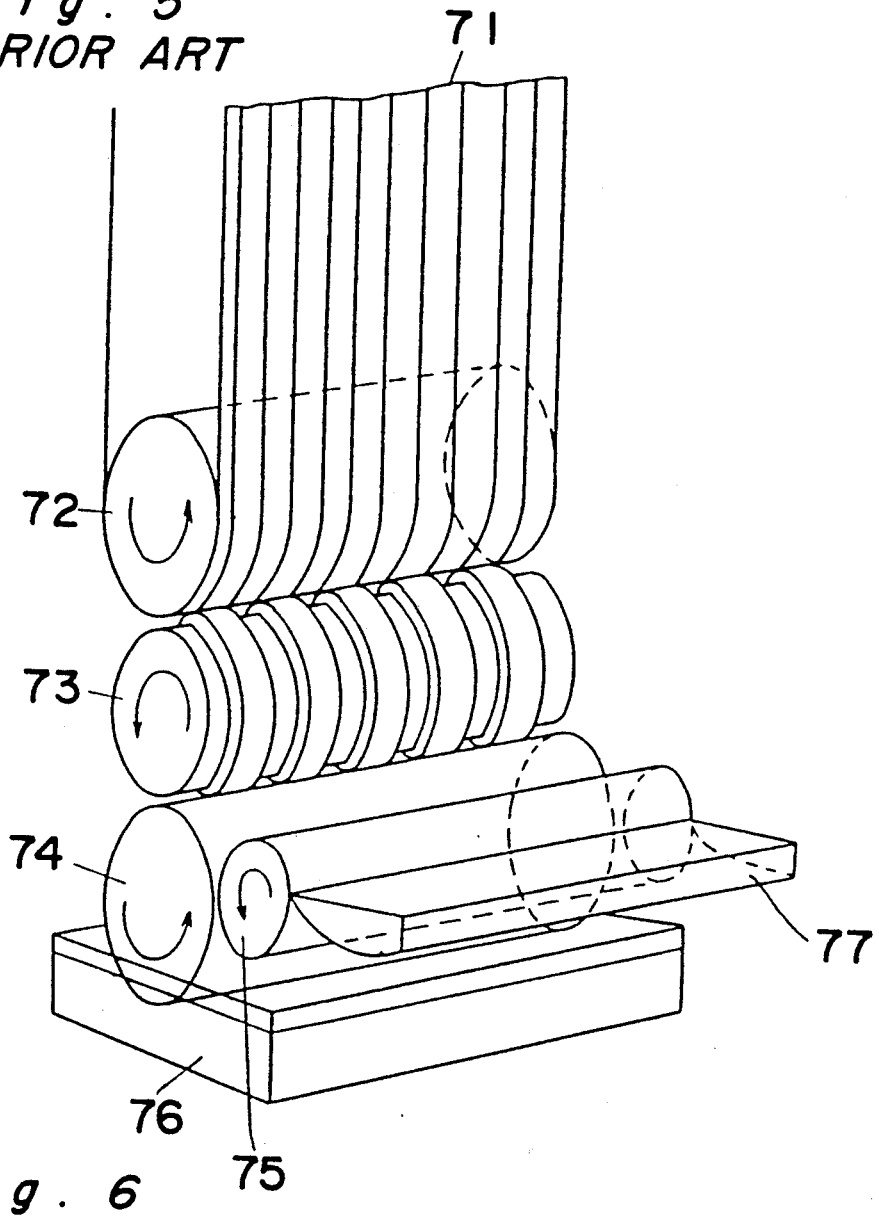
Fig. 5 PRIOR ART
FIG. 5 is a schematic perspective view of the conventional reverse roll coating machine used to form a striped pattern of a coated layer on the web of film.

It is to be noted that, although in the foregoing description the nozzle face 16 has been described as substantially rounded, it may be flat. Also, the coating to form a striped pattern of coated layers according to the present invention can be equally applicable to the system wherein the film web is turned around a back-up roll such as used in the prior art machine of FIG. 5.

Furthermore, the present invention is effective to provide coated layers of a uniform thickness and free from the occurrence of rounded edges which would otherwise result from run or sagging of the coating material during drying. The reason therefor will now be described.

Figure 4:
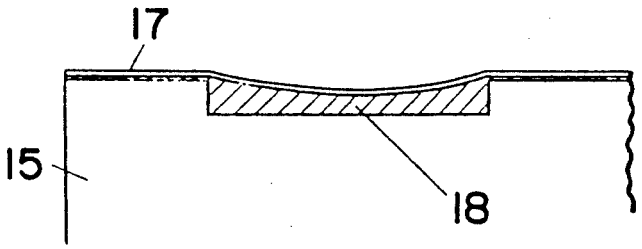
FIGS. 3 and 4 are cross-sectional views taken along the lines III—III and IV—IV in FIG. 2.

FIG. 4 illlustrates a cross-sectional representation of the applicator block taken along the line IV—IV in FIG. 2.

Figure 6:
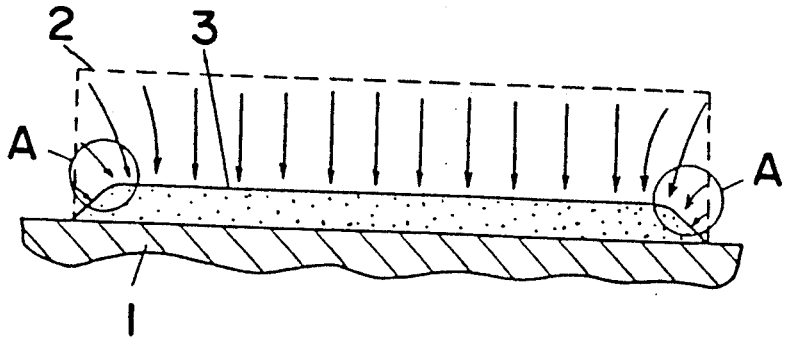
FIG. 6 is a diagrammatic representation, in section, of the coated layer on the web of film used to explain how the coating material applied varies during a drying.

The details of the operation of the coating head assembly of the above described construction will now be described. As shown in FIG. 2, the film web 17 is turned around the nozzle face 16 under tension in a direction conforming to the direction of movement thereof. Depending on the tension applied to the film web 17 so turned around the nozzle face 16, portions of the film web 17 aligned with the applicator grooves 18 protrude into the respective applicator grooves 18. The extent to which each of those portions of the film web 17 protruding into the respective applicator grooves 18 in maximum at a center thereof intermediate the width of the respective applicator groove 18 as best shown in FIG. 4. It is well known that the thickness of each paint layer as coated is proportional to the depth of the associated applicator groove 18. Accordingly, the phenomenon as shown in FIG. 4 analogously speaks of the situation in which the depth of each applicator groove is smaller at a center thereof intermediate the width than at each side thereof, and therefore, each paint layer as coated has a varying thickness minimum at the center thereof and maximum at each side thereof.

Where the coating is carried out to form each coated layer having a uniform thickness over the width of the film web as shown in FIG. 6, the volume shrinkage occurs at side edges of the respective coated layer during the drying process, resulting in the formation of the rounded edges as herinbefore discussed in connection with the prior art system. In order to substantially eliminate this problem, the present invention applie a tension to the film web 17 to cause those portions of the film web 17 aligned with the respective applicator grooves 18 to protrude into the applicator groove 18, so that each of the coated layers as coated can exhibit a maximum thickness at the opposite sides thereof and a minimum thickness at the center thereof. By so doing, during the drying process which takes place subsequent to the coating, each painted layer after the drying thereof can exhibit a uniform thickness over the width thereof with no rounded edges occurring. In other words, reduction in thickness at the center of each of the coated layers on the film web 17, which is observed during the application of the coating material, can be advantageously compensated for by the volume shrinkage which takes place during the subsequent drying process, thereby providing coated layers which have uniform thicknesses over the respective widths thereof.

By way of example, when the coating was effected while the film web 17 was tensioned to about 20g/mm, the distance (hereinafter referred to as a set-up distance) between a wet portion and a flat portion of each coated layer was about 30 micrometers. On the other hand, where the coating material was uniformly applied, the set-up distance of each coated layer after drying was on the order of hundreds of micrometers. Thus, it will readily be seen that, according to the present invention, the formation of the rounded edges in each coated layer can be advantageously eliminated.

It is to be noted that, although in the foregoing description the coating has been described as being applied to form a striped pattern of the coated layers on the film web, the present invention can be equally applicable to a coating over the entire area of a web desired to be coated, provided that the latter tends to pose a problem associated with the formation of rounded edges resulting from run or sagging of the coating material.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A coating head assembly for applying a coating material to a web, which assembly comprises:

an applicator block;

a reservoir defined in said applicator block for storage of the coating material;

a generally elongated nozzle integral with said applicator block and extending in a direction substantially transverse to the direction of transportation of the web, a free edge of said nozzle opposite to said applicator block having a generally curved nozzle face, said nozzle face having a plurality of applicator grooves defined therein and said nozzle having a plurality of slit-shaped openings defined therein respectively communicating with said plurality of applicator grooves for feeding the coating material under pressure to said plurality of applicator grooves; and means for feeding the coating material from said reservoir to said plurality of slit-shaped openings.

2. A coating head assembly as recited in claim 1, wherein said feeding means comprises a plurality of supply passages defined in said applicator block and being in communication, respectively, with said plurality of applicator grooves.

3. A coating head assembly for applying a coating material to a web, which assembly comprises:

an applicator block;

a reservoir defined in said applicator block for storage of the coating material; and a generally elongated nozzle integral with said applicator block and extending in a direction substantially transverse to the direction of transportation of the web, a free edge of said nozzle opposite to said applicator block having a generally curved nozzle face, said nozzle face having a plurality of applicator grooves defined therein in communication with said reservoir;

wherein each of said plurality of applicator grooves is defined by a base surface adapted to be substantially parallel to the direction of transportation of the web, a bottom wall extending from said base surface, and two side walls extending from said base surface and extending perpendicularly from said bottom wall.

4. A coating method for coating a coating material on one surface of a web, which comprises the steps of:

transporting the web in sliding contact with a generally curved nozzle face defined in a nozzle, said nozzle face having a plurality of applicator grooves defined therein for the application of the coating material to the web, and said nozzle having a plurality of slit-shaped openings defined therein for feeding the coating material under pressure to said plurality of applicator grooves, respectively; and applying a predetermined tension to the web during transportation thereof in sliding contact with the nozzle face to cause respective portions of the web aligned with the applicator grooves to protrude into the respective applicator grooves, and coating the coating material onto the web through the slit-shaped openings in the nozzle and through the applicator grooves in the nozzle face.

5. A coating method as recited in claim 4, wherein coating the coating material onto the web through the slit-shaped openings and through the applicator grooves includes feeding the coating material from a reservoir to the slit-shaped openings respectively through a plurality of supply passages.

6. A coating method for coating a coating material on one surface of a web, which comprises the steps of:

transporting the web in sliding contact with a generally curved nozzle face defined in a nozzle, said nozzle face having a plurality of applicator grooves defined therein for the application of the coating material to the web, and each of said plurality of applicator grooves being defined by a base surface substantially parallel to the direction in which the web is transported, a bottom wall extending from said base surface, and two side walls extending from said base surface and extending perpendicularly from said bottom wall; and applying a predetermined tension to the web during the transportation thereof in sliding contact with the nozzle face to cause respective portions of the web aligned with the applicator grooves to protrude into the respective applicator grooves, and coating the coating material onto the web through the applicator grooves in the nozzle face.

* * * * *